US006478558B2

(12) United States Patent
Yamanaka et al.

(10) Patent No.: US 6,478,558 B2
(45) Date of Patent: Nov. 12, 2002

(54) OSCILLATING PISTON TYPE COMPRESSOR AND METHOD OF MANUFACTURING PISTON THEREOF

(75) Inventors: Toshio Yamanaka, Yokohama (JP); Yukio Maeda, Yokohama (JP); Kazuya Kato, Ohhira (JP); Fumitaka Nishioka, Ohhira (JP); Nobuo Abe, Ohhira (JP); Minoru Tateno, Ohhira (JP); Tatsuo Horie, Ohhira (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/799,528

(22) Filed: Mar. 7, 2001

(65) Prior Publication Data

US 2002/0028152 A1 Mar. 7, 2002

(30) Foreign Application Priority Data

Sep. 6, 2000 (JP) ..... 2000-274984

(51) Int. Cl.[7] ..... F04C 18/356
(52) U.S. Cl. ..... 418/66
(58) Field of Search ..... 418/66

(56) References Cited

U.S. PATENT DOCUMENTS

| | | | | | |
|---|---|---|---|---|---|
| 1,876,370 A | * | 9/1932 | Weber | ..... | 418/66 |
| 2,584,865 A | * | 2/1952 | Gordinier | ..... | 418/66 |

FOREIGN PATENT DOCUMENTS

| | | | | |
|---|---|---|---|---|
| FR | 720335 | * 12/1931 | ..... | 418/66 |
| FR | 1360196 | * 3/1964 | ..... | 418/66 |
| JP | 07-108445 | * 4/1995 | | |
| JP | 08-247064 | * 9/1996 | | |

* cited by examiner

*Primary Examiner*—John J. Vrablik
(74) *Attorney, Agent, or Firm*—Antonelli, Terry, Stout & Kraus, LLP

(57) ABSTRACT

An oscillating piston type compressor has a piston formed integral with a blade. The compressor accommodates in a casing a compression mechanism section and a motor section, the mechanism including the piston having a plate-shaped blade integrally formed on a cylindrical portion is fitted onto an eccentric portion of a crankshaft to perform orbital motion relative to an inner peripheral surface of a cylinder, the plate-shaped blade being formed at its radial end surface with a recess or a protrusion, which serves as a reference of position.

3 Claims, 9 Drawing Sheets

OSCILLATING PISTON TYPE COMPRESSOR AND METHOD OF MANUFACTURING PISTON THEREOF

BACKGROUND OF THE INVENTION

The present invention relates to an oscillating piston type compressor mainly used in an air conditioner or a refrigerating apparatus, and more particularly to an oscillating piston type compressor provided with a plate-shaped blade, which is projectingly formed integral with a cylindrical portion of a piston to partition a cylinder chamber into a suction chamber and a compression chamber and is shaped for efficient processing.

As disclosed in Japanese Patent Unexamined Publication No. 108445/1995, there has been known a double grinding processing method for grinding a workpiece by use of a pair of opposed grinding stones, as a technique for processing a pair of parallel surfaces. This processing method will now be described in details with reference to FIG. 12.

In FIG. 12, a carrier 60 for moving a workpiece passes between a pair of grinding stones 50*a* and 50*b* which rotate in opposite direction. In FIG. 12, the workpiece is a cylindrical ring 55. Before the carrier 60 enters between the grinding stones 50*a* and 50*b*, the ring 55 is inserted into an insertion portion 60*a* provided on the carrier 60 at, e.g., a point A, and the ring 55 passes between the grinding stones 50*a* and 50*b* with rotation of the carrier 60, thereby completing the processing. The ring 55 having been processed is ejected at, for example, a point B after the carrier 60 have passed between the grinding stones 50*a* and 50*b*. The double grinding processing method of the above constitution has a feature in that the both annular end surfaces of the ring 55 can be processed to a width defined by the grinding stones 50*a* and 50*b* to have favorable parallelism and flatness. This processing method has another feature in that parallel flat surfaces can be continuously ground in a short period of time, and the method has been used for processing end surfaces of a cylinder or side surfaces of a flat plate, as a technique for mass-production of parallel flat surfaces.

Further, Japanese Patent Unexamined Publication No. 247064/1996 discloses a configuration of a piston having a plate-shaped blade integrally formed on a cylindrical body, but a radial end of the blade is flat in conventional pistons.

In the case of using the above-described double grinding processing method to process side surfaces of a plate-shaped blade integrally formed on and projecting from a cylindrical portion of a piston, there are caused the following problems.

Matters taken account of in the prior art double grinding processing method are a width between and parallelism of two surfaces to be processed, and flatness and surface roughness of the respective surfaces. A workpiece is not constrained in the carrier in a direction, along which processing proceeds, and amounts of processing performed by the opposed two grinding stones are not forcedbly controlled.

Forces are applied on the workpiece to feed the same into a gap formed by the two grinding stones, and two surfaces of the workpiece are processed during movements of the workpiece. In this processing method, the gap between the grinding stones is controlled so as to obtain a desired width of the workpiece at the completion of processing. Accordingly, respective amounts of processing applied to the two surfaces to be processed vary depending on the nature of the grinding stones, but there is no means for individually controlling such amounts of processing.

As described above, since the prior art double processing method is not one, in which a workpiece is forcedly grasped by, e.g., a chuck, consideration is not commonly taken into to obtain accuracy of relative positions between the workpiece and other elements constituting members.

In the case where the double grinding processing is applied to blade side surfaces of a piston, it is difficult due to properties of such processing method to obtain accuracy of positional relationship between the blade side surfaces and a cylindrical portion. For example, this processing method has a difficulty in meeting a demand for carrying out processing in such a manner that a center line of the both blade side surfaces in a radial direction runs through a center of the cylindrical portion. More specifically, in the case where processing is to be controlled in such a manner that the center line of the both blade side surfaces in the radial direction runs through the center of the cylindrical portion, there is caused the need of changing amounts of processing on the respective blade side surfaces on the basis of the cylindrical portion. However, the conventional double grinding processing methods cannot control amounts of processing on the respective surfaces and so it is impossible to meet the above demand.

Also, with a blade of a prior art piston, a radial end portion of the blade is flat, so that when positioning is determined by grasping the blade, any portions except side surfaces of the blade being processed cannot determine positioning. Therefore, the blade of the prior art piston is configured such that when the blade side surfaces are processed, only the blade side surfaces themselves can be made a reference and constrained in position. That is, with a configuration of the conventional blade, it is difficult to process the blade side surfaces in a state, in which other portions than the blade side surfaces are constrained by a jig.

Therefore, when the blade side surfaces of the conventional piston are to be processed, it is common to perform processing in such a manner that one of the two blade side surfaces is used as a reference and the other of the blade side surfaces reserves machining allowance, to then invert the two blade side surfaces to further perform processing, and to repeat such work, in which processing is alternately applied to each blade side surface to obtain accuracy for a width dimension of the blade itself and a position of the blade with respect to the cylindrical portion, which makes a very inefficient operation.

SUMMARY OF THE INVENTION

In view of the above-described problems in the prior art, it is an object of the present invention to provide an oscillating piston type compressor provided with a piston, which is shaped to afford processing a blade by a double grinding method capable of efficient processing of parallel flat surfaces, and a method for processing the blade.

The present invention is achieved to attain the above object.

A first oscillating piston type compressor for attaining the above object comprises a cylinder having a hollow cylinder chamber; a piston formed integral with a plate-shaped blade, which is supported by the cylinder to be capable of rocking and radially sliding relative to the cylinder and partitions the cylinder chamber into a suction chamber and a compression chamber; a crankshaft inserted into the piston to cause the piston to make orbital motion in the cylinder chamber; and end plates supporting the crankshaft and closing both end openings of the cylinder, and a recess or a protrusion formed on a radial end surface of the blade of the piston to serve as a reference for positioning relative to an axis of the piston.

A second oscillating piston type compressor for attaining the above object has a feature in that in the first oscillating piston type compressor, the recess formed on the blade of the piston is a groove tapered to have a cross section in a direction perpendicular to the axis of the piston, decreasing in width toward the axis, and an extension of an axis of symmetry of the tapered portions runs substantially through a center of a cylindrical portion.

A third oscillating piston type compressor for attaining the above object has a feature in that in the first or second oscillating piston type compressor 1, a material for the piston is a sintered alloy adapted for molding with a die, and the recess or protrusion is molded with the die.

Also, a first method for attaining the above object is a method of processing side surfaces of a plate-shaped blade projectingly and integrally formed on a piston, the method comprising the steps of forming a recess or a protrusion, which makes a reference for positioning relative to an axis of the piston, on a radial end surface of the plate-shaped blade, and thereafter using two grinding stones with opposed annular grinding surfaces to perform grinding on two side surfaces of the blade in a state, in which an inside or outside diameter portion of the piston is supported and a support member is fitted into the reference from radially of the blade to support the same.

A second method for attaining the above object has a feature in that in the first method, after a gap defined between the two grinding stones is made larger than a width of the blade before double grinding, the blade is moved about processing portions of the two grinding stones and two side surfaces of the blade are processed while the gap between the two grinding stones is being decreased.

A third method for attaining the above object has a feature in that in the first or second method, an oblique angle is imparted to axes of rotation of the two grinding stones provided with opposed annular grinding surfaces, the grinding stones are configured to have portions in parallel to a median line of the oblique angle in a region where the gap between the two grinding stones becomes smallest, the grinding stones and the piston are arranged such that a center line of the gap defined between the two grinding stones formed in parallel to each other coincides with a line running through centers of a groove formed on the blade of the piston and a cylindrical portion of the piston, the blade of the piston is caused to reciprocate or pass repeatedly in one direction through the gap defined between the two grinding stones, and the blade is processed while the gap between the grinding stones is sequentially decreased.

A fourth method for attaining the above object has a feature in that in the first or second or third method, processing is performed by adding an oscillation motion, in which the blade of the piston is caused to reciprocate in a radial direction of the grinding stones arranged opposed to each other.

A fifth method for attaining the above object has a feature in that in the first or second or third or fourth method, a material for the piston is made from a sintered alloy adapted for molding with a die, the recess or protrusion serving as the reference is formed on a radial end surface of the blade upon molding with the die, and thereafter double grinding is applied on side surfaces of the blade.

DETAILED DESCRIPTION OF THE PREFERRED EMBODIMENTS

Figure 1:
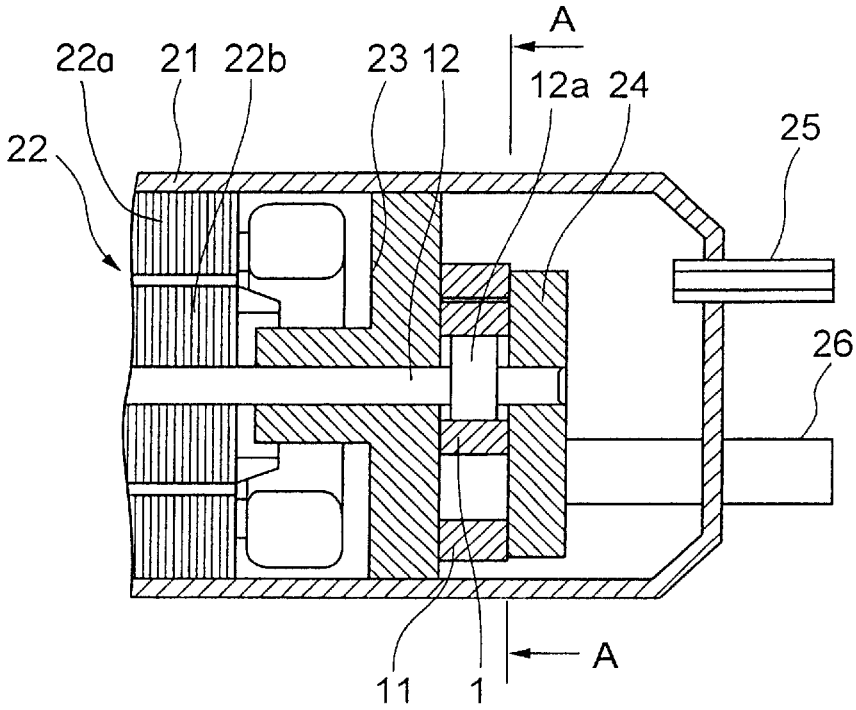
FIG. 1 is a partial cross-sectional view showing an embodiment of an oscillating piston type compressor according to the present invention.
Figure 2:
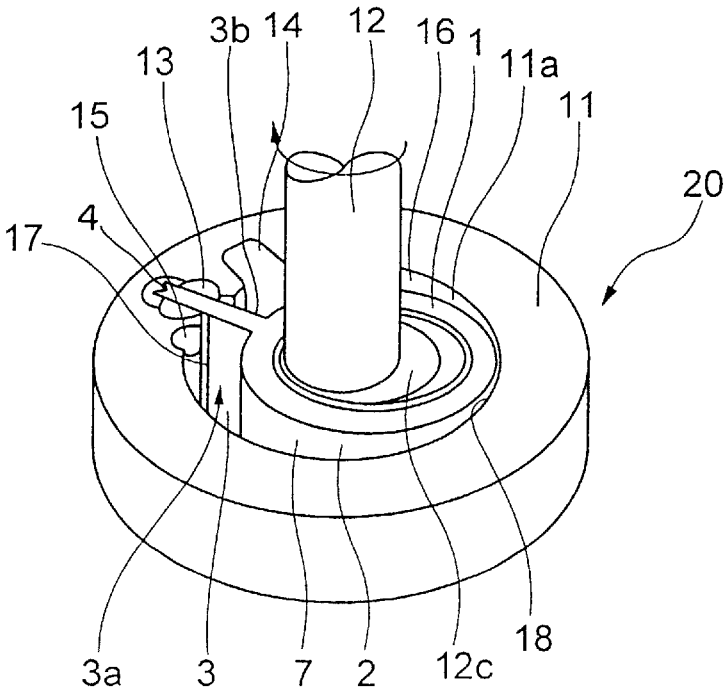
FIG. 2 is an explanatory drawing showing a cross section taken along the line A—A in FIG. 1 in a birds-eye view.

Embodiments of an oscillating piston type compressor according to the present invention will now be described with reference to FIGS. 1 to 11. FIG. 1 is a fragmentary, cross-sectional view showing an embodiment of an oscillating piston type compressor according to the present invention, and FIG. 2 is a cross sectional view taken along the line A—A in FIG. 1 in a birds-eye view.

An oscillating piston type compressor is composed of a case 21 being a closed container, a motor section 22 consisting of a stator 22*a* and a rotor 22*b*, and a compression mechanism section 20 rotatingly driven by the motor section 22, the both sections being accommodated in the case. The compression mechanism section 20 includes as its main constituent parts a main bearing 23 fixed to the case 21, a cylinder 11, a sub bearing 24 and a piston 1. The main bearing 23 and the sub bearing 24 close both end openings of the cylinder 11, and cooperate with the cylinder 11 to form a work chamber consisting of a low pressure chamber (suction chamber) 16 and a high pressure chamber (compression chamber) 17. A cylindrical portion 2 of the piston 1 is fitted onto an eccentric portion 12*a* of a crankshaft 12 fixed to the rotor 22*b* to be rotatable. Further, the cylindrical portion 2 of the piston 1 is integrally formed at a single location on an outer periphery thereof with a blade a (plate-shape protrusion) 3. The shoes 13 permit the blade (plate-shaped protrusion) 3 rock with respect to the cylinder 11, and radially slidably supports blade, which serves to partition an interior of the cilynder 11 into the low pressure chamber (suction chamber) 16 and the high pressure chamber (compression chamber) 17. Therefore, while the blade 3 inhibits rotation of the piston 1, the eccentric rotation of the eccentric portion 12*a* causes the piston 1 to perform orbital motion in the cylinder chamber to repeat actions of suction and compression.

More specifically, since the piston 1 having the blade 3 integrally formed on the cylindrical portion 2 is incorporated in the compression mechanism section 20, the eccentric rotation of the eccentric portion 12*a* of the crankshaft 12 directly connected to the motor section 22 causes the piston 1 to perform orbital motion with respect to an inner surface 11*a* of the cylinder 11 while the piston 1 is prevented by the blade 3 from rotating. The interior of the cylinder 11 is partitioned into the low pressure chamber (suction chamber) 16 and the high pressure chamber (compression chamber) 17 by the blade 3 of the piston 1 and a sealing portion 18. A working fluid (refrigerant gas) sucked from a suction port 14 is compressed by the orbital motion of the piston 1 to be supplied to a refrigerating cycle (not shown) from a discharge port 15. In addition, the reference numeral 25 denotes a discharge pipe connected to the discharge port 15 formed to the sub bearing 24, and 26 a suction pipe directly connected to the suction port 14 formed in the sub bearing 24. Therefore, the working fluid sucked into the suction chamber 16 from the suction pipe 26 is compressed, and the compressed working fluid enters into a discharge chamber (not shown) in the sub bearing 24 from the discharge port 15 through a discharge valve (not shown). Thereafter, the working fluid is discharged into the case 21 to be discharged to an external refrigerating cycle (not shown) from the discharge pipe 25.

While this example is a single-cylinder compressor with the cylinder 11, the piston 1 and a pair of shoes 13, the same is with the case, in which the number of cylinders is increased to, e.g., two.

The oscillating piston type compressor functions with the above-described arrangement.

As a function of a compressor, the working fluid compressed in the high pressure chamber (compression chamber) 17 is discharged from the discharge 15. Leakage of the working fluid at other portions is responsible for lowering the volumetric efficiency of the compressor. Therefore, respective constituent members, which separate the low pressure chamber (suction chamber) 16 and the high pressure chamber (compression chamber) from each other and make sliding portions, must suppress leakage of the working fluid and move relative to one another, and so form minute gaps of at most 0.03 mm therebetween. That is, while relative rocking movements are possible between the cylinder 11 and the shoes 13, minute gaps are formed in order to prevent leakage of the working fluid. In addition, minute gaps are similarly defined between the piston 1 and the end surface of the main bearing 23, between the piston 1 and the end surface of the sub bearing 24, between the outside diameter of the piston 1 and the inside diameter of the piston 1, and between the shoes 13 and the end surfaces of the main bearing 23 and the sub bearing 24. Due to such functional requirements, the respective members are manufactured with high precision in order to form minute gaps between the sliding members.

With respect to the piston 1, rotation of the crankshaft 12 causes the blade 3 to perform a combination of rocking movements and reciprocating movements in a groove formed by the two shoes 13. Since the movements are effected while the minute gaps are maintained, it is required that the side surfaces 3*a* and 3*b* of the blade 3 be manufactured in flatness and width dimension with high accuracy. Further, it is required that the side surfaces 3*a* and 3*b* be manufactured in parallel to the axis of the cylindrical portion 2.

Figure 3:
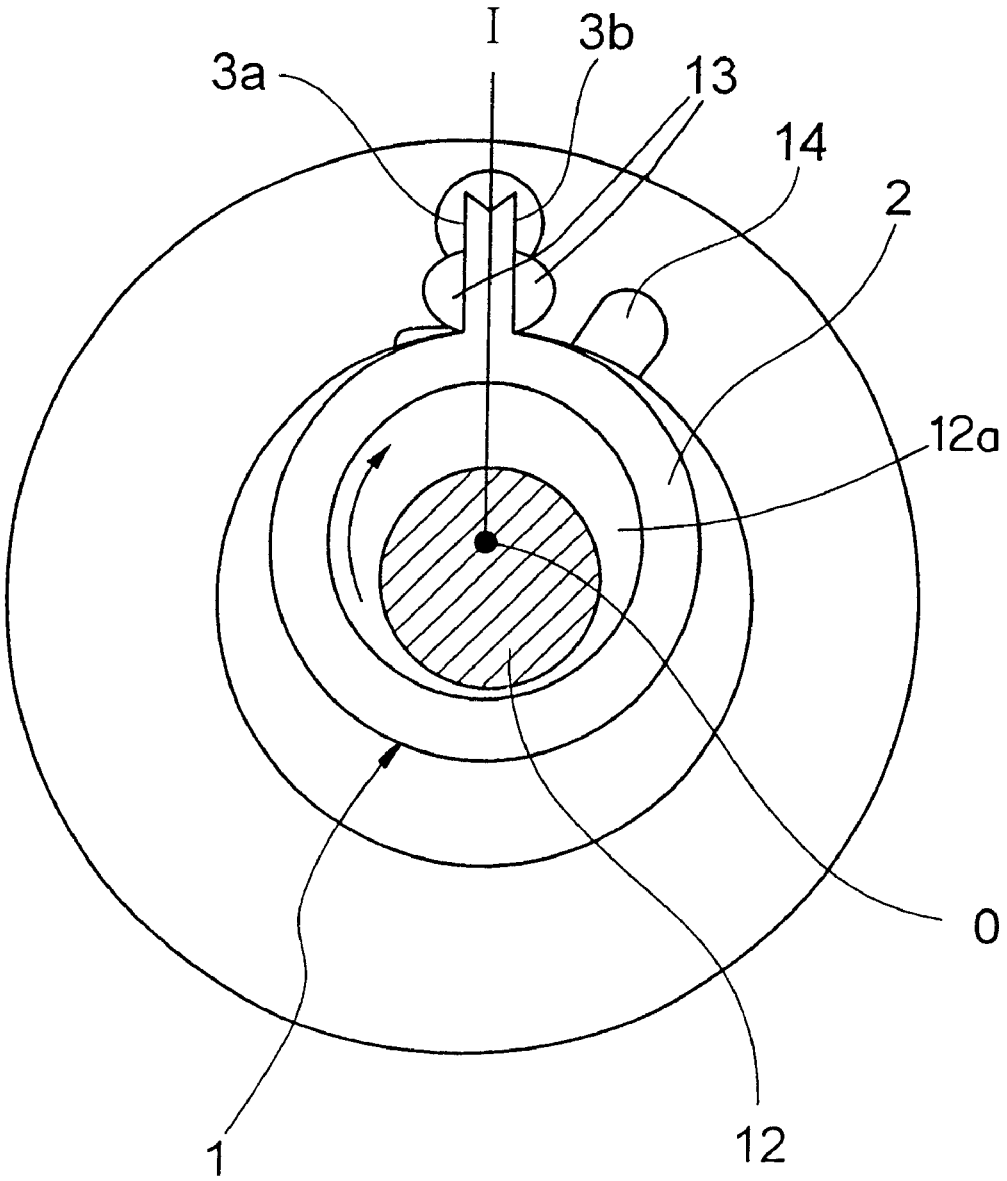
FIG. 3 is a cross-sectional view taken along the line A—A in FIG. 1.

Here, FIG. 3 is a cross-sectional view taken along the line A—A in FIG. 1 and shows a state, in which the cylindrical portion 2 of the piston 1 is present at a location closest to the shoes 13. In order that the blade 3 be accommodated in the shoes 13 with the piston 1 in a position shown in FIG. 3, a center line 1 of the side surfaces 3*a* and 3*b* of the blade 3 must run near a center O of the cylindrical portion 2 of the piston. which the cylindrical portion 2 of the piston 1 is present at a location closest to the shoes 13. In order that the blade 3 be accommodated in the shoes 13 with the piston 1 in a position shown in FIG. 4A, a center line L of the side surfaces 3*a* and 3*b* of the blade 3 must run near a center O of the cylindrical portion 2 of the piston.

Figure 4A:
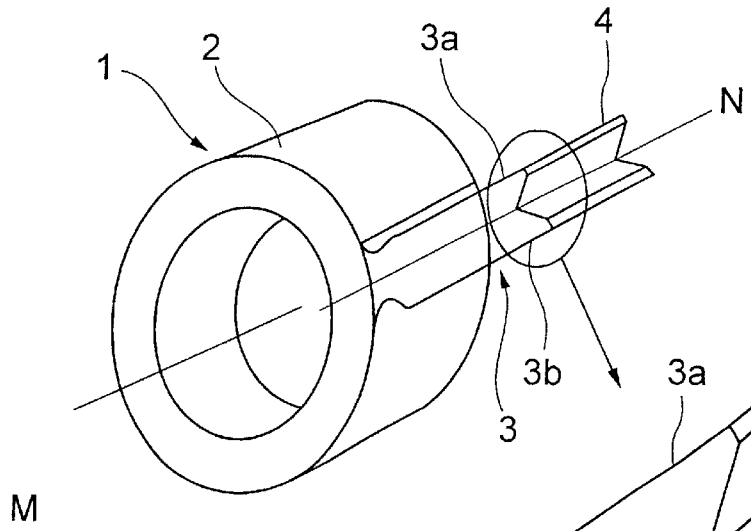
FIG. 4A is a view showing a shape of a piston.

FIG. 4A is a view illustrating an example of the piston 1 in a birds-eye view in the light of the above- described requirements.

As shown in FIG. 4A, this example is constructed such that a groove 4 is formed on a diametrically extending end surface 4 of the blade 3 to serve as a positional reference. This groove 4 is formed to be parallel with an axis M of the cylindrical portion 2. The side surfaces 3*a* and 3*b* are constructed to be identical to each other in their distances to a straight line N connecting the center of the groove 4 and the center of the cylindrical portion 2. The groove 4 is defined by two tapered surfaces 4*a* and 4*b*, and a median line, by which an angle formed by the tapered surfaces 4*a* and 4*b* is divided into two halves, runs near the center of the cylindrical portion 2.

That is, the straight line connecting the groove 4 and the cylindrical portion 2 is made a reference of accuracy in manufacturing or evaluating the blade 3 and the cylindrical portion 2 in an associated configuration, and is effective for enhancing the productivity of the piston as will be described later.

Figure 4B:
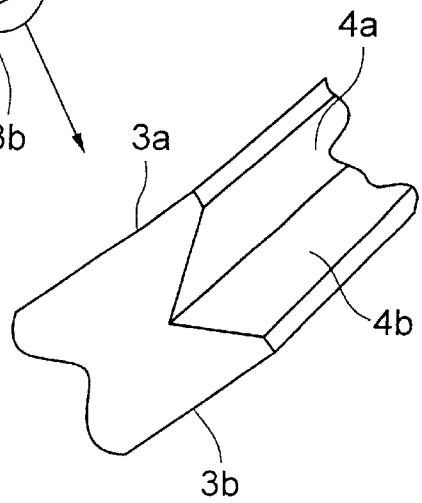
FIGS. 4B 4C 4D and 4E are views showing various shapes of a groove of a blade.
Figure 4C:
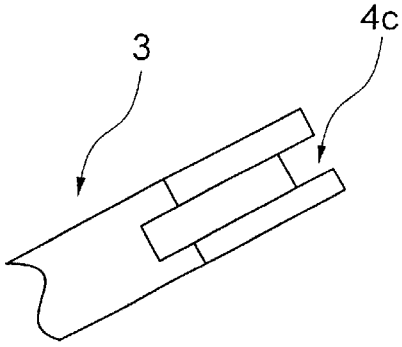
Figure 4D:
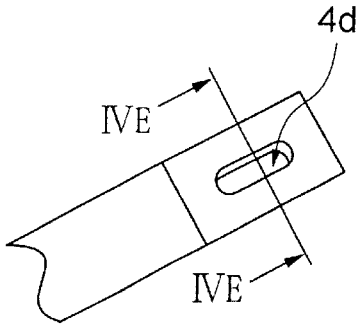
Figure 4E:
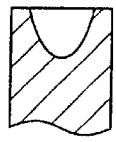

In this example, a configuration exhibiting the function as a positional reference is exemplified by the groove 4 having the tapered surfaces 4*a* and 4*b*. In addition to this, as shown in FIG. 4B, the same object can be attained by a groove 4*c* having a rectangular-shaped cross section or other grooves having an arcuate-shaped cross section, a U-shaped cross section, as shown in FIG. 4E, or the like. Alternatively, as shown in FIG. 4C, a recess 4*d* having an arcuate-shaped cross section or a U-shaped cross section can attain the same object. Furthermore, the same function can be achieved by a recess having a conical, cylindrical, prismatic shape, hemispherical or other shape, which can determine the position of the blade 3. Moreover, in contrast to the example shown in FIG. 4A, a configuration suffices to protrude the diametrically extending end surface 4 of the blade 3. However, for the centering purpose, the groove defined by the tapered surfaces 3*a* and 3*b* is simplest in terms of manufacture and measurement of accuracy, and is a configuration which fits the object for enhancement of production efficiency.

Further, in the case where a sintered material adapted for molding with a die (not shown) is used as a material for manufacturing the piston 1, the groove 4 can be manufactured by molding with a die (not shown). Sintering alloy is adapted for a technique of filling a raw metal powder in a die (not shown), compressing and molding the same, then taking out the molded metal powder from a die (not shown), and raising the molded metal powder to a temperature, at which the molded metal powder is not completely melted but diffusion-bonded, to obtain a molded body. A shape being a reversal of the shape of the groove is formed in the die (not shown), whereby the groove 4 can be formed in the piston 1 manufactured with a sintered metal. Formation of the groove 4 in the blade 3 by this technique enables efficient and inexpensive production.

Figure 5A:
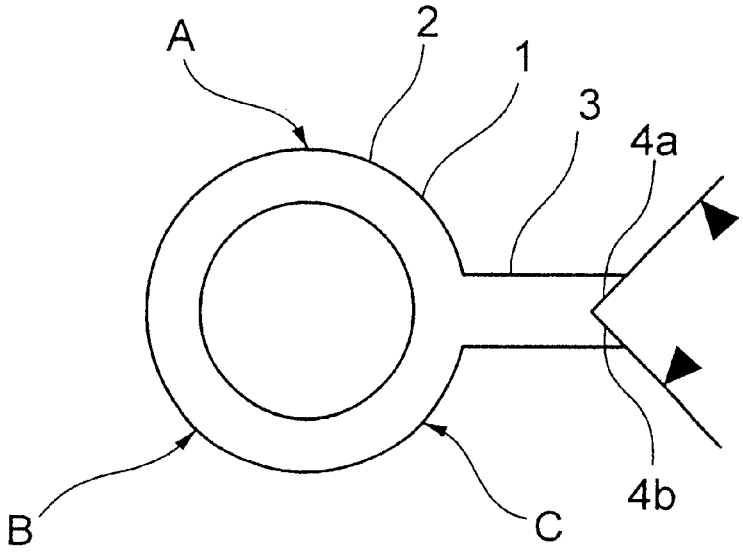
FIGS. 5A and 5B are views showing means for constraining a position of the piston.
Figure 5B:
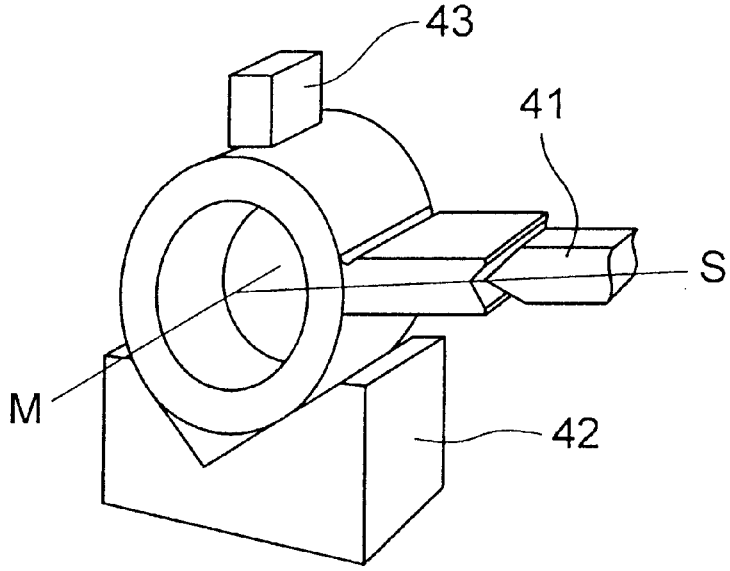

FIGS. 5A and 5B are a plane view and a view for illustrating the function of the groove 4. A center of the cylindrical portion 2 of the piston 1 can be determined by constraining three points on the outside diameter, e.g., A, B and C represented by a symbol Δ. Meanwhile, position of the blade 3 relative to the cylinder 2 can be determined by constraining the tapered surfaces 4*a* and 3*b* of the groove 4.

More concretely, as shown in FIG. 5B, the cylindrical portion 2 of the piston 1 is mounted on a bearer 42 having a V-shaped cross section, and is constrained by a block 43 in a direction opposed to the bearer 42 having a V-shaped cross section. Moreover, a supporter 41 having a shape, to which the tapered surfaces 4*a* and 4*b* are transferred, is inserted into the groove 4. A center line S of the supporter 41 constraining the groove 4 is arranged to run through the axis M of the cylindrical portion 2, whereby the cylindrical portion 2 and the blade 3 can be constrained. In this manner, when the groove 4 is formed before the processing the blade 3 of the piston 1 and the blade 3 is constrained by the above-described technique for determining positions of the cylindrical portion 2 and the blade 3, it is then possible to set a position required for the processing the side surfaces 3*a* and 3*b* of the blade 3, and to simultaneously process the side surfaces 3*a* and 3*b* of the blade 3 with the above-described position constrained.

An explanation will now be given as to a method according to the present invention for processing the side surfaces of the blade by double grinding with reference to FIGS. 6 to 11.

Figure 6:
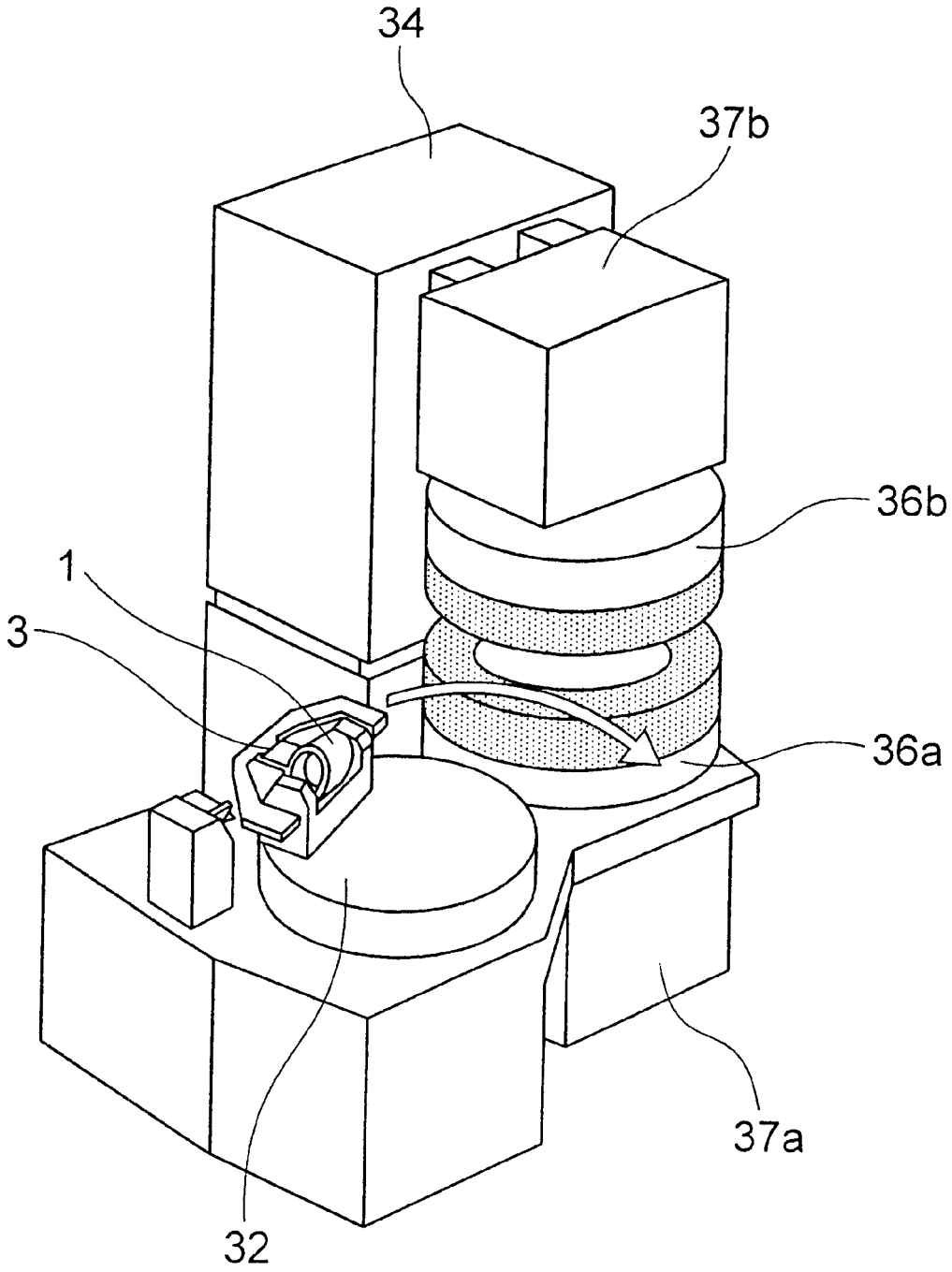
FIG. 6 is an explanatory drawing showing a double grinding processing method of the piston.

FIG. 6 is a view illustrating a state, in which a double grinding apparatus is used to process the piston. The piston 1 is grasped by a jig 31, which in turn is latched by an index table 32. The index table 32 is mounted on a base 33, on which a column 34 is provided. A lower grinding stone 36*a* for processing, together with a rotary drive shaft (not shown) for rotating the lower grinding stone 36*a* is arranged on a first vertical shaft 37*a* for determining a position in a vertical direction. Further, an upper grinding stone 36*b* for processing, together with a rotary drive shaft (not shown) is similarly arranged on a second vertical shaft 37*b* for determining a position in a vertical direction.

With such an arrangement, the index table 32 is revolved to feed the blade 3 of the piston 1 into a gap defined between the lower grinding stone 36*a* and the upper grinding stone 36*b* for processing of the side surfaces of the blade 3. Here, in the course of passage of the blade 3 through the gap between the lower grinding stone 36*a* and the upper grinding stone 36*b*, the both side surfaces of the blade 3 are simultaneously removed with the result that the blade is formed to desired dimensions. Position of the blade 3 relative to the axis of the piston 1 can be adjusted by using the first vertical shaft 37*a* and the second vertical shaft 37*b* to move the positions of the lower grinding stone 36*a* and the upper grinding stone 36*b*. Also, widthwise position of the blade 3 can be adjusted by means of the first vertical shaft 37*a* and the second vertical shaft 37*b*. In the case where the center of the blade 3 is to be made to correspond to the center of the piston 1, the first vertical shaft 37*a* and the second vertical shaft 37*b* suffice to be adjusted in such a manner that the center line of the gap defined between the lower grinding stone 36*a* and the upper grinding stone 36*b* runs through the center of the piston 1.

The above-described contents will be described in detail hereinafter.

Figure 7:
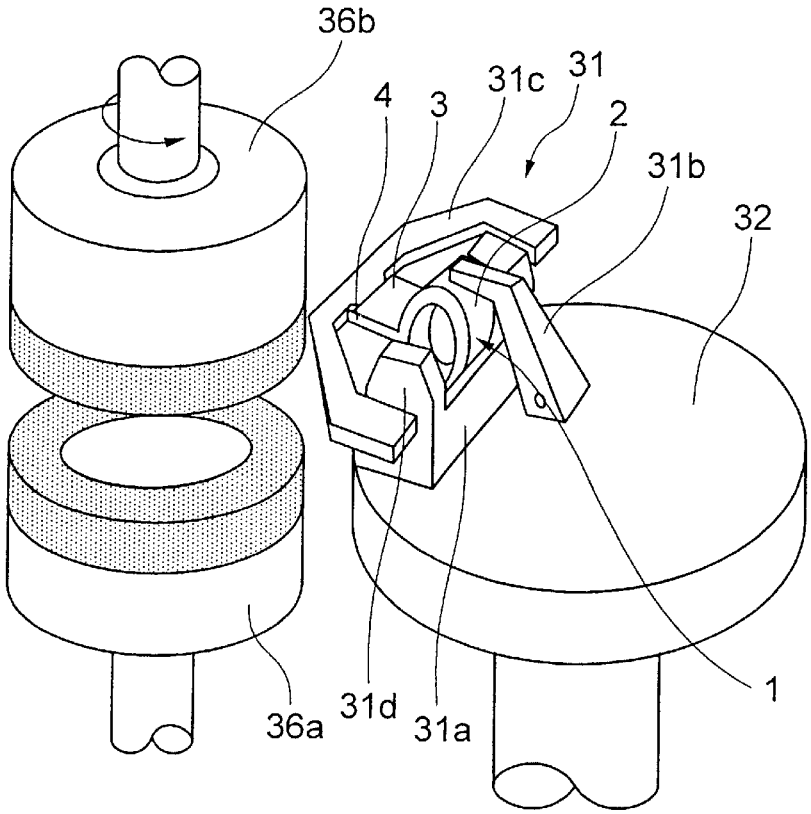
FIG. 7 is an enlarged explanatory drawing showing a part in the vicinity of a processing point in FIG. 6.

FIG. 7 is a view showing in enlarged scale an arrangement of the jig 31 and the two grinding stones 36*a* and 36*b* in FIG. 6. An explanation will first be given to a method for mounting the piston 1 on the jig 31.

The piston 1 is set by fitting the groove 4 of the blade 3 onto the supporter 31*c* of the jig 31, and then mounting the cylindrical portion 2 on the bearer 31*a* of the jig 31. Subsequently, a diametrical damper 31*b* is pressed against the cylindrical portion 2 with a force, which allows the piston 1 to rotate, and an axial clamper 31*d* is then similarly pressed against the end surfaces of the cylindrical portion 2 with the force, which allows the piston 1 to rotate. In this state, the supporter 31*c* is moved in the axial direction of the piston 1, and position of the groove 4 of the blade 3 is determined by the tip end of the supporter.

In the above-described procedure, when the supporter 31*c* is intensely pressed against the groove 4, the blade 3 will be deformed thereby, so that it is desirable that pressing of the supporter 31*c* be performed with the minimum force, which enables determining the position of the blade 3. The pressing force of the axial damper 31*d* is increased in a state, in which the position of the blade 3 has been determined by the supporter 31*c*. Mounting of the piston 1 on the jig 31 is completed in the above-described procedure.

Here, while an explanation has been given by way of a construction of the jig for positioning the blade on the basis of the outside diameter of the cylindrical portion 2 of the piston 1, the construction of the jig may be based on the inside diameter of the cylindrical portion 2. When the inside diameter is adopted as a reference, the inside diameter will be grasped to make the jig complicated. However, in the case where the blade is to be processed on the basis of the inside diameter for reason of function or manufacturing process of the piston, the inside diameter can be adopted as a reference. The present application encompasses an example, in which the blade 3 is processed on the basis of the inside diameter.

Subsequently, the index table 32 is rotated in a direction of an arrow c to feed the blade 3 of the piston 1 mounted on the jig 31, between the two rotating grinding stones 36*a* and 36*b*. Here, the gap defined between the grinding stones 36*a* and 36*b* is adjusted so that the blade 3 is processed to a required dimension. Further, positions of the lower grinding stone 36*a* and the upper grinding stone 36*b* are adjusted by the first vertical shaft and the second vertical shaft so that the center of the gap defined by the respective stones coincides with the center of the blade 3 required after processing. While such a relationship between the piston 1 and the grinding stones 36*a* and 36*b* is maintained, the piston 1 is continued to rotate until the blade 3 of the piston 1 is separated from the grinding stones, and then processing of the side surfaces of the blade 3 is completed.

As described above, the groove 4 is provided on the blade 3 and the jig is used serving as holding on the basis of the position of the groove 4 as illustrated in this example, thus enabling processing the both side surfaces of the blade 3 by the double grinding processing with the position being constrained.

In the course of the processing, positions of the grinding stones 36*a* and 36*b* are controlled so that the center of the blade 3 comes to an expected position. Therefore, an amount, by which the lower grinding stone 36*a* and the upper grinding stone 36*b* perform processing, varies depending on a material used.

Figure 8:
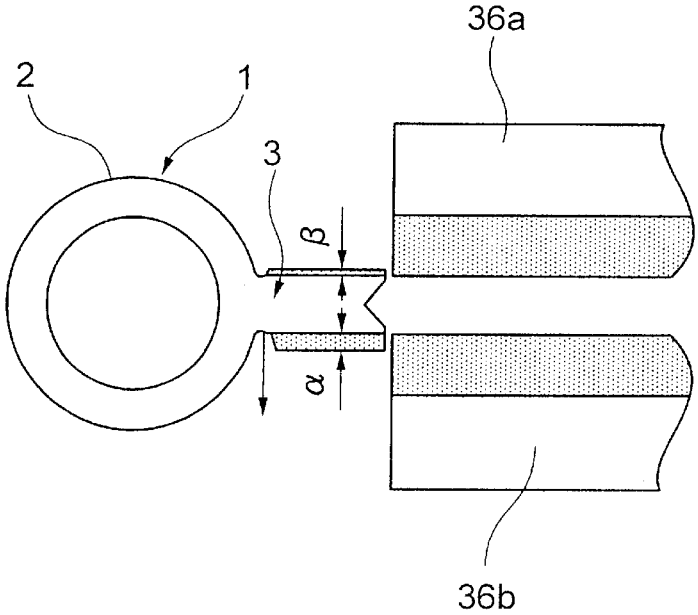
FIG. 8 is an explanatory drawing showing unbalance of quantities of processing.
Figure 9:
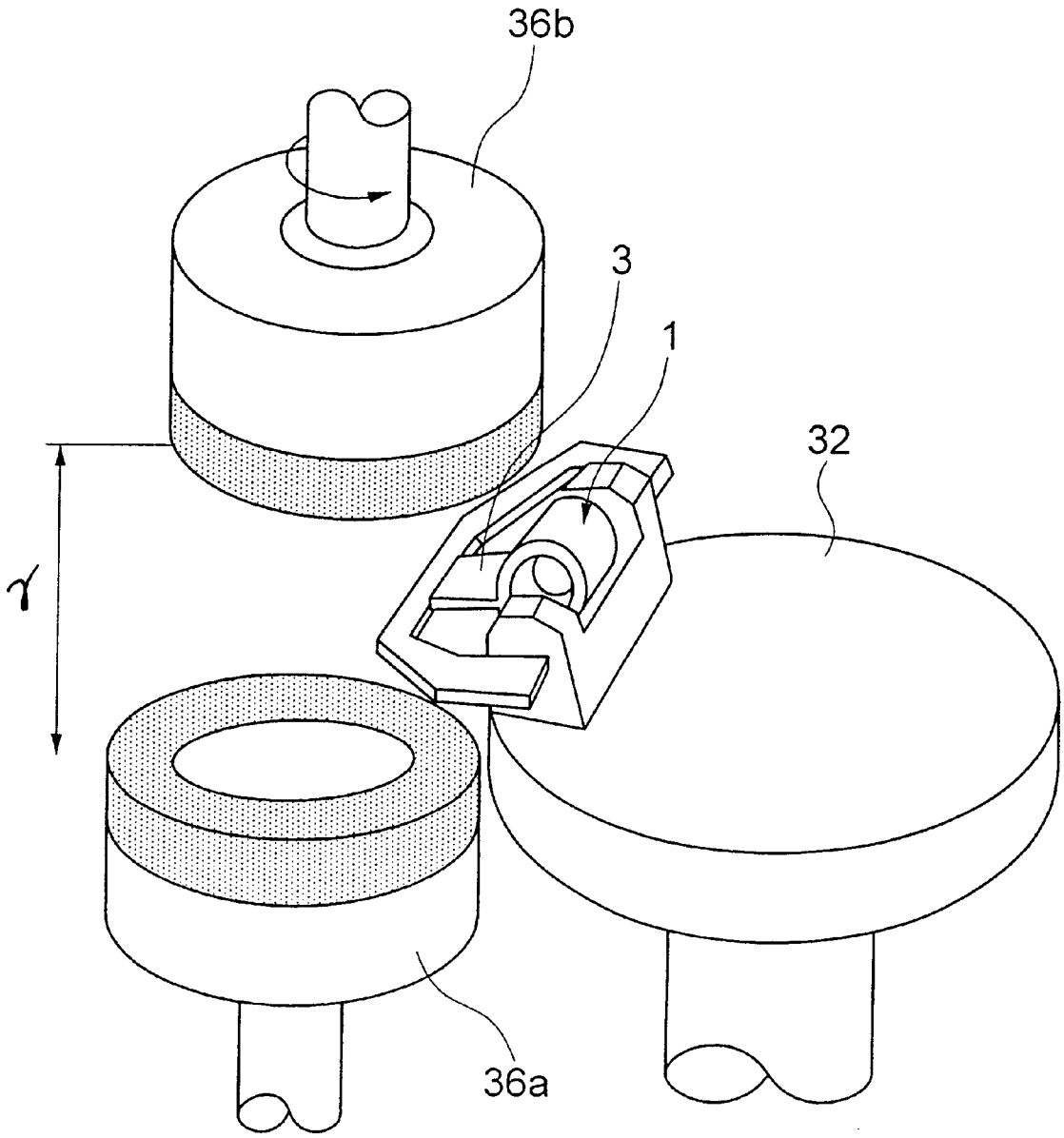
FIG. 9 is an explanatory drawing showing a double grinding processing method of a piston.

For example, as shown in FIG. 8, an amount, by which the lower grinding stone 36*a* performs processing, is increased in some cases depending upon a state before processing. FIG. 8 shows an example of the positional relationship of the blade 3, the lower grinding stone 36*a* and the upper grinding stone 36*b* in a direction of processing. In this example, an amount α, by which the lower grinding stone 36*a* performs processing, is increased relative to an amount β, by which the upper grinding stone 36*b* performs processing.

On the contrary, an amount, by which the upper grinding stone 36*b* performs processing, is increased in some cases. In this manner, when the upper and lower grinding stones become unbalanced in amount of processing, one of them having a larger amount of processing is increased in work resistance to cause generation of forces in a direction of rotation of the blade. Without the supporter 31*c,* there is generated a phenomenon that the piston rotates during the processing, thus causing a failure in that steps is generated on processed surfaces. However, since the supporter 31*c* acts to maintain the position of the blade 3 during processing, such failure can be prevented from being generated. Also, even if the piston is not rotated during processing, the processing proceeds while the blade 3 is subjected to forces, which are caused by unbalance in work resistance to tend to bend and deform the blade in a direction, in which an amount of processing is less. The supporter 31*c* can reduce the deformation caused due to such bending and deforming forces.

Also, without the positioning groove 4, the jig 31 is used to perform clamping and processing in a state, in which positioning is beforehand effected by the use of the side surfaces of the blade before being mounted on the jig 31. However, positioning is hence deteriorated in accuracy because of an error caused by positioning of other portions than the jig and minute positional deviation caused when mounted on the jig. Therefore, the supporter 31*c* is also effective in enhancing an accuracy, with which the blade 3 is positioned. Moreover, without the use of the supporter 31*c,* the axial damper 31*a* or the radial damper 31*d* must be used to intensely clamp the piston 1 so as not to prevent the same from moving during the processing, which is responsible for making the piston 1 susceptible to deformation due to grasping. Accordingly, the supporter 31*c* is also effective in decreasing deformation due to grasping by the jig.

An example has been described above, in which the blade 3 passes once through the gap defined between the lower grinding stone 36*a* and the upper grinding stone 36*b*. In order to make accuracy of processing further favorable, it is desirable to adopt the following processing method. Contents of the method will now be described with reference to FIG. 9.

A gap γ between the lower grinding stone 36*a* and the upper grinding stone 36*b* is enlarged so as to eliminate interference with the blade 3. In this state, the index table 32 is rotated to insert the blade 3 into the gap defined between the grinding stone 36*a* and the grindingstone 36*b*. Thereafter, the processing is made to go on while the first vertical shaft and the second vertical shaft are used to gradually narrow the gap γ. In this case, either of the grinding stone 36*a* and the grinding stone 36*b* first starts processing depending on a state of a material before the processing. When the lower grinding stone 36*a* and the upper grinding stone 36*b* are controlled to become identical to each other in moving speed, the lower grinding stone 36*a* and the upper grinding stone 36*b* finally become uniform in amount of processing, thus balancing amounts of processing. Accordingly, it is possible to reduce deformation during processing to facilitate enhancement of accuracy of processing. Here, the supporter 31*c* can exhibit a role for resisting forces, which tend to rotate the piston in a state, in which either of the grinding stone 36*a* and the grinding stone 36*b* performs processing.

Figure 10A:
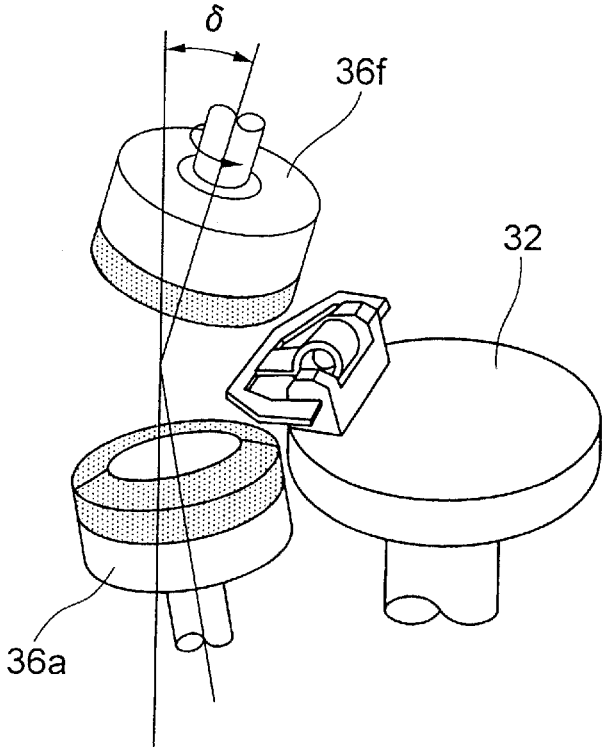
FIGS. 10A and 10B are explanatory drawings showing a method for performing processing by inclining grinding stones.
Figure 10B:
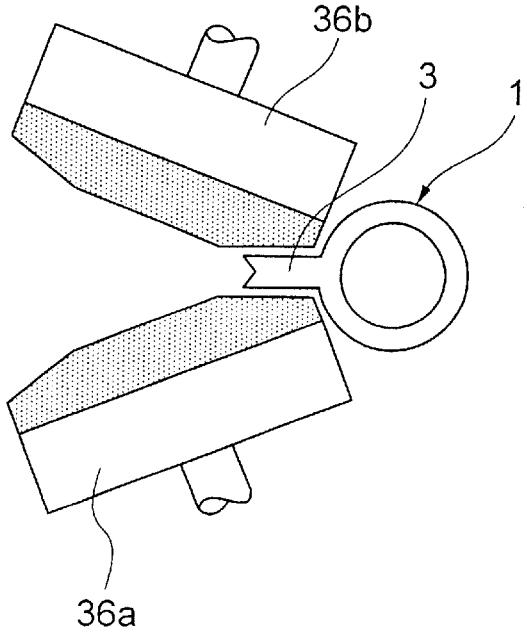

Further, a technique for reducing work resistance to enhance accuracy of processing will now be described with reference to FIGS. 10A and 10B. In FIG. 10A, axes of rotation of the lower grinding stone 36*a* and the upper grinding stone 36*b* are set to define therebetween an oblique angle δ. The grinding stones are formed by a diamond dresser (not shown) or the like so that the blade passes a position where a gap between the lower grinding stone 36*a* and the upper grinding stone 36*b* is narrowed and the lower grinding stone 36*a* and the upper grinding stone 36*b* are formed with portions in parallel to the rotating flat surface of the index table 32. That is, as shown in FIG. 10B, processed surfaces of the lower grinding stone 36*a* and the upper grinding stone 36*b,* respectively, are formed to be umbrella-shaped. In this manner, portions of the lower grinding stone 36*a* and the upper grinding stone 36*b,* corresponding to the narrowest gap therebetween are not planes but line segments. Since contact portions between the grinding stones are not planar but substantially linear, processing of the blade in an area between the line segments can reduce work resistance to be effective in enhancing accuracy of processing.

Figure 11:
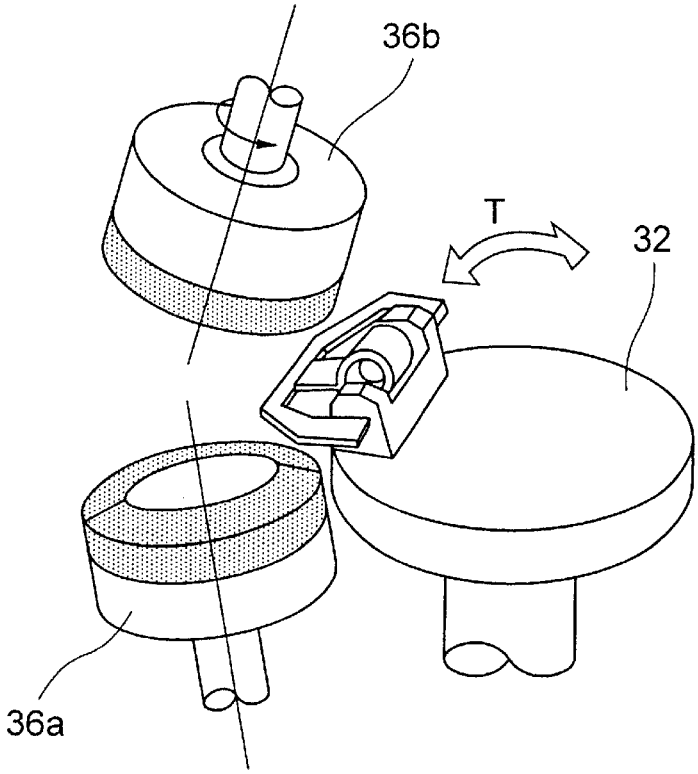
FIG. 11 is an explanatory drawing showing an oscillation method.
Figure 12:
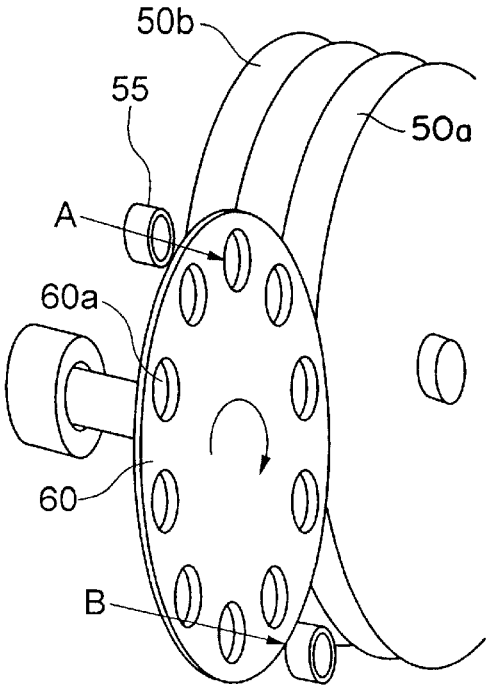
FIG. 12 PRIOR ART
FIG. 12 is an explanatory drawing showing a prior art double grinding processing method.

Moreover, as shown in FIG. 11, accuracy can be enhanced by adding an oscillation motion, in which the index table causes forward and rearward movements of the blade 3 between the lower grinding stone 36*a* and the upper grinding stone 36*b*. Such oscillation motion can be applied to the processing methods described with reference to FIGS. 9, 10A and 10B.

In addition, the processing method, in which a material for the piston 1 is manufactured by using a sintered alloy molded with a die and the positional reference 4 is provided by grinding the blade 3 by the double grinding after the material is formed by the die, makes it possible to set the positional reference 4 without resort to machining and contribute to enhancement in productivity.

According to the present invention, a groove, a recess or a protrusion is formed on the blade of the piston to serve as a positional reference, whereby the both side surfaces of the blade can be simultaneously processed by the double grinding method with the blade being constrained in position. Possibility of application of such double grinding processing method means possibility of processing of high accuracy in a short period of time, which leads to enhancement in production efficiency of the piston. The provision of such a piston enables providing an inexpensive oscillating piston type compressor.

In addition, a material for the piston is manufactured from a sintered alloy for molding with a die and the groove of the blade is formed by the die at the time of molding the material, whereby it is not necessary to form the groove by machining such as cutting or grinding after the manufacture of the material, and it is possible to enhance processing efficiency of the piston.

What is claimed is:

1. An oscillating piston type compressor comprising: a cylinder having a hollow cylinder chamber; a piston formed integral with a plate-shaped blade, which is supported by the cylinder to be capable of rocking and radially sliding relative to the cylinder and partitions the cylinder chamber into a suction chamber and a compression chamber; a crankshaft inserted into the piston to cause the piston to make orbital motion in the cylinder chamber; and end plates supporting the crankshaft and closing both end openings of the cylinder, and a recess formed on a radial end surface of the blade of the piston to serve as a reference for positioning relative to an axis of the piston, the recess being formed by two radial end most surfaces of the blade, the two radial end most surfaces being tapered to have a cross section, in a direction perpendicular to the axis of the piston, decreasing in width toward the axis.

2. The oscillating piston type compressor according to claim 1, wherein an extension of an axis of symmetry of the tapered portions runs substantially through a center of a cylindrical portion.

3. The oscillating piston type compressor according to claim 1, wherein a material for the piston is a sintered alloy adapted for molding with a die, and the recess is molded with the die.

* * * * *